US005113162A

United States Patent [19]

Umehara et al.

[11] Patent Number: 5,113,162

[45] Date of Patent: May 12, 1992

[54] FOCUS MAGNET WITH SEPARATE STATIC AND DYNAMIC CONTROL COILS

[75] Inventors: Teruo Umehara, Hanyu; Fumihiko Takahashi, Menuma, both of Japan

[73] Assignee: Hitachi Metals, Ltd., Tokyo, Japan

[21] Appl. No.: 704,875

[22] Filed: May 23, 1991

[51] Int. Cl.[5] ..... H01F 3/12; H01F 7/00; H01J 23/08

[52] U.S. Cl. ..... 335/210; 335/213; 335/306; 315/5.35; 250/396 ML

[58] Field of Search ..... 335/210-214, 335/296, 297, 299, 302, 306; 315/5.34, 5.35; 313/340; 250/396 ML

[56] References Cited

U.S. PATENT DOCUMENTS 3,686,527 8/1972 Gabor ..... 315/5.35
4,975,668 12/1990 Nishinuma ..... 335/210

FOREIGN PATENT DOCUMENTS 1060048 1/1957 Fed. Rep. of Germany ..... 335/210
61211940 9/1963 Japan .
5512576 5/1972 Japan .
1276546 2/1984 Japan .

*Primary Examiner*—Harold Broome
*Assistant Examiner*—Ramon Barrera
*Attorney, Agent, or Firm*—Finnegan, Henderson, Farabow, Garrett & Dunner

[57] ABSTRACT

A focus magnet having (a) three axially magnetized hollow cylindrical permanent magnets disposed concentrically along a center axis of a cathode ray tube such that their opposite magnetic poles face each other; (b) yokes in the form of hollow discs disposed on both sides of the permanent magnets; (c) a static control coil disposed inside a center permanent magnet; (d) a horizontal dynamic control coil disposed inside one of side permanent magnets; and (e) a vertical dynamic control coil disposed inside the other side permanent magnet, whereby electron beams passing in the cathode ray tube are converged to a small spot diameter.

4 Claims, 3 Drawing Sheets

FOCUS MAGNET WITH SEPARATE STATIC AND DYNAMIC CONTROL COILS

BACKGROUND OF THE INVENTION

The present invention relates to a focus magnet for projection-type cathode ray tubes for use in high-definition video projectors, high-definition television sets, etc.

Conventionally, electrostatic-type electron beam converging apparatuses have been used for CRTs, and magnetic field-type convergence apparatuses are used only for special tubes such as X-ray tubes, magnetrons, travelling-wave tubes, etc. Recently, as a result of an increased demand for high-resolution CRTs such as high-definition television sets, etc., the magnetic field-type convergence apparatuses have been getting more widely used. The magnetic field-type convergence apparatuses include an electromagnet-type and a permanent magnet-type. The electromagnet-type convergence apparatuses are disadvantageous in that they are large in size and need power supplies. Accordingly, the permanent magnet-type convergence apparatuses are becoming a mainstay.

FIG. 4 shows one example of the permanent magnet-type convergence apparatuses, which comprises a hollow cylindrical permanent magnet 1, which is axially magnetized such that its end surfaces are provided with N and S magnetic poles, respectively. Fixed to both end surfaces of the permanent magnet 1 are yokes 2 each in the form of a hollow disc made of a ferromagnetic material. Disposed inside the permanent magnet 1 is a bobbin 4 which receives a coil 3. The coil 3 is connected to a lead wire (not shown). By this structure, when the coil 4 is energized, a magnetic field generated by the permanent magnet 1 can be adjusted such that the electron beams are converged on the center axis.

In the above conventional focus magnet, electron beams are converged on a center axis at a spot diameter of 0.3–0.35 mm. However, the spot diameter is required to be as small as 0.25–0.28 mm for recent high-definition projectors. If it is tried in the conventional focus magnet to focus electron beams to such a small spot diameter, halation appears due to a large spherical aberration. To obviate this problem, there was proposed a focus magnet comprising at least two ring-shaped permanent magnets with their opposite magnetic poles facing each other, a half-width of a magnetic flux density distribution along a z-axis (center axis) of the ring-shaped permanent magnets being 80–200% of an inner diameter of each permanent magnet (Japanese Patent Laid-Open No. 61-211940). In this focus magnet, a ratio of the half-width $B_w$ of the magnetic flux density distribution along a z-axis of the ring-shaped permanent magnets to the inner diameter of the permanent magnet, namely, $H=B_w/L$ is used as a parameter, and to increase "H" drastically, it is effective to use at least two ring-shaped permanent magnets with their opposite magnetic poles facing each other, and it is desirable to increase the "H" value to 0.8 or more to reduce the spherical aberration.

FIG. 3 is a vertical cross-sectional view of a main portion of the focus magnet according to the above proposal. In FIG. 3, the same parts as those in FIG. 4 are assigned with the same reference numerals as those in FIG. 4. In most cases, both of the two coils 3, 3 are used for dynamic control synchronized with vertical and horizontal scanning, and either one of the coils 3, 3 is used not only for dynamic control but also for static control. However, when the static control and the dynamic control are conducted by the same coil, it is necessary to use a control current consisting of a DC current superimposed thereover with an AC current. In this case, the variable range of the static control should be considerably wide by taking into consideration the unevenness of the magnetic force of the permanent magnet 1. For this purpose, it is preferable that the coils 3 have a large inductance. However, since a horizontal frequency is 15.75 kHz in the case of a television image, high voltage is required to carry out the focus modulation of the horizontal scanning.

To solve the above problem, there was proposed a focus magnet in which the static control and the dynamic control are carried out by separate coils (for instance, Japanese Utility Model Laid-Open No. 55-12576 and Japanese Patent Laid-Open No. 1-276546). In this focus magnet, a DC current is supplied to the static control coil, and an AC current is supplied to the dynamic control coil for the purpose of focus correction. Accordingly, the dynamic control coil may have a small inductance, leading to a low-voltage operation.

However, since both of the static control coil and the dynamic control coil are concentrically disposed inside the same permanent magnet, they are electromagnetically coupled to each other. Therefore, the AC current flowing through the dynamic control coil induces a current variation in the static control coil, which functions to offset the change of a magnetic flux for the dynamic control. As a result, the function of the dynamic control coil to change the focal length of electron beams is reduced. This means that a larger correction current should be supplied to the dynamic control coil. This is disadvantageous in that larger electric energy is consumed by the coils.

OBJECT AND SUMMARY OF THE INVENTION

Accordingly, an object of the present invention is to provide a focus magnet which can provide a larger half-width of a magnetic flux density distribution along a center axis of a permanent magnet assembly with a smaller electric energy consumption.

Thus, the focus magnet according to the present invention comprises (a) three axially magnetized hollow cylindrical permanent magnets disposed concentrically along a center axis of a cathode ray tube such that their opposite magnetic poles face each other; (b) yokes in the form of hollow discs disposed on both sides of the permanent magnets; (c) a static control coil disposed inside a center permanent magnet; (d) a horizontal dynamic control coil disposed inside one of side permanent magnets; and (e) a vertical dynamic control coil disposed inside the other side permanent magnet, whereby electron beams passing in the cathode ray tube are converged to a small spot diameter.

DETAILED DESCRIPTION OF THE INVENTION

Figure 1:
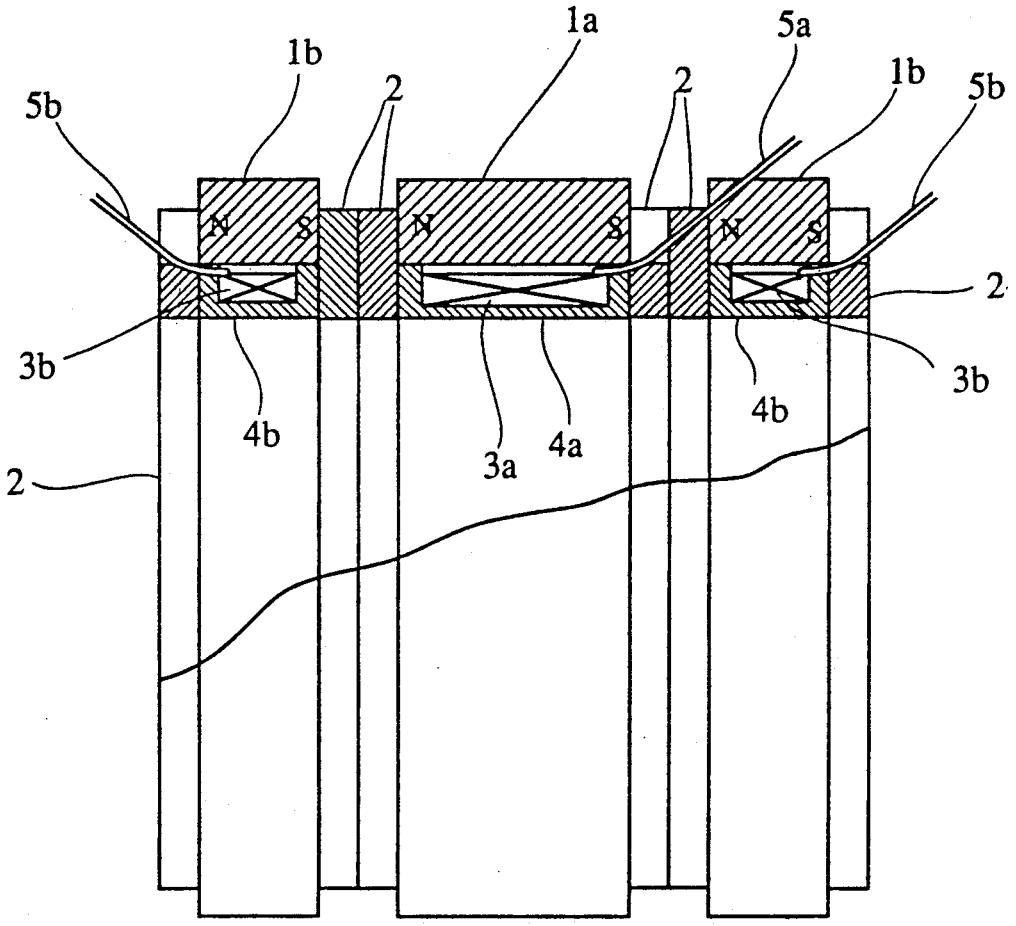
FIG. 1 is a partially cross-sectional side view showing the focus magnet according to one embodiment of the present invention.
Figure 3:
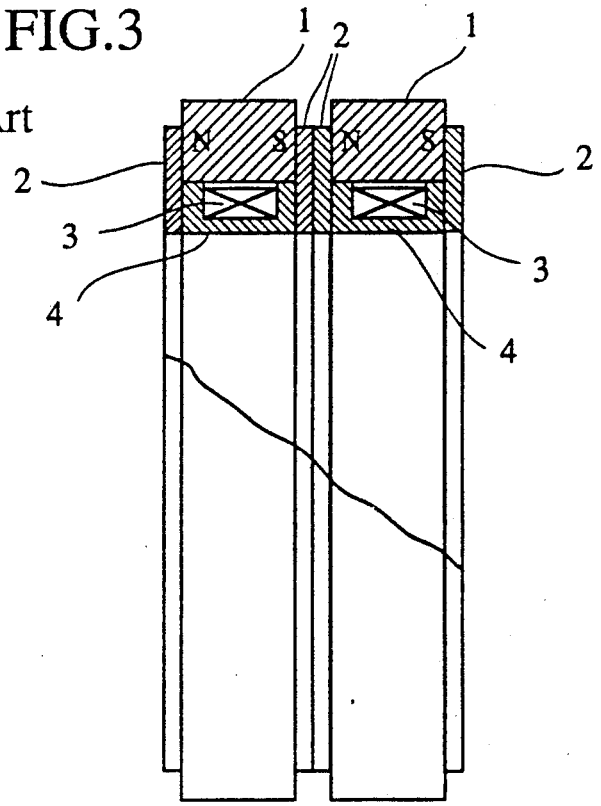
FIG.3 Prior Art
FIG. 3 is a partially cross-sectional side view showing a conventional focus magnet.
Figure 4:
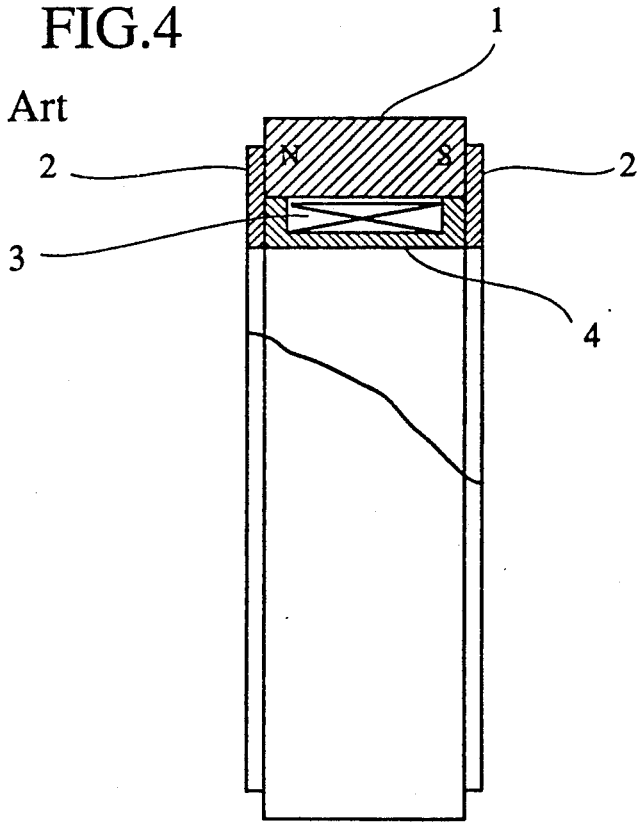
FIG.4 Prior Art
FIG. 4 is a partially cross-sectional side view showing another conventional focus magnet.

Referring to FIG. 1, in which the same reference numerals as those in FIGS. 3 and 4 are assigned to the same parts as those in FIGS. 3 and 4, the focus magnet according to the present invention comprises three hollow cylindrical permanent magnets (one center permanent magnet 1*a* and two side permanent magnets 1*b*, 1*b*), and yokes 2, 2 . . . fixed to both end surfaces of each permanent magnet. The magnetic poles (N and S) of the adjacent permanent magnets are opposite each other. In a typical example, the center permanent magnet 1*a* has an outer diameter of 65 mm, an inner diameter of 50 mm and a thickness of 16 mm, each side permanent magnet 1*b* has an outer diameter of 65 mm, an inner diameter of 50 mm and a thickness of 8 mm, and each yoke 2 has an outer diameter of 60 mm, an inner diameter of 50 mm and a thickness of 5 mm.

Each permanent magnet is preferably made of rare earth magnet materials such as Sm-Co magnet materials, Nd-Fe-B magnet materials, etc. The Sm-Co magnet materials and the Nd-Fe-B magnet materials themselves are already known to the public. Accordingly, their detailed explanation will be omitted here. Incidentally, if permissible, other types of permanent magnet materials may also be used.

With respect to the yoke 2, it may be made of soft ferrite materials which are sintered bodies of oxides of at least one metal selected from Ni, Zn, Mn, Mg, Cu, Li Ba, V, Cr, Ca, etc. and trivalent iron oxide ($Fe_2O_3$). Typical soft ferrites are Ni-Zn type ferrite, Mn-Zn type ferrite, Mg-Zn type ferrite, Cu-Zn type ferrite, Li-Zn type ferrite, etc., and Mn-Zn type ferrite is preferable for the purpose of the present invention. Other soft magnetic materials for the yoke 2 include steel.

A static control coil 3*a* is wound around a bobbin 4*a* 15 disposed inside the center permanent magnet 1*a*, and a dynamic control coil 3*b* is wound around a bobbin 4*b* disposed inside each of the two side permanent magnets 1*b*, 1*b*. One of the dynamic control coil 3*b* is used as a horizontal dynamic control coil and the other dynamic control coil 3*b* is used as a vertical dynamic control coil. For instance, the static control coil 3*a* is constituted by a wire having a diameter of 0.2 mm wound by 570 turns, and the dynamic control coil 3*b* is constituted by a wire having a diameter of 0.5 mm wound by 26 turns. Incidentally, 5*a* and 5*b* denote lead wires.

The permanent magnets 1*a*, 1*b*, 1*b* and the yokes 2, 2 . . . are bonded together by an adhesive, such that the opposite magnetic poles of the adjacent permanent magnets are facing each other and that a pair of the yokes 2, 2 are fixed to both end surfaces of each permanent magnet as shown in FIG. 1.

A permanent magnet assembly thus formed is inserted into a plastic holder (not shown) made of heat-resistant plastics such as 66 nylon.

Incidentally, for the purpose of increasing a half-width of a magnetic flux density distribution along a center axis of the permanent magnet assembly, it is preferable that each permanent magnet has substantially the same inner and outer diameters, and that the center permanent magnet 1*a* has a longer axial length (thickness) than the side permanent magnets 1*b*, 1*b*.

Figure 2:
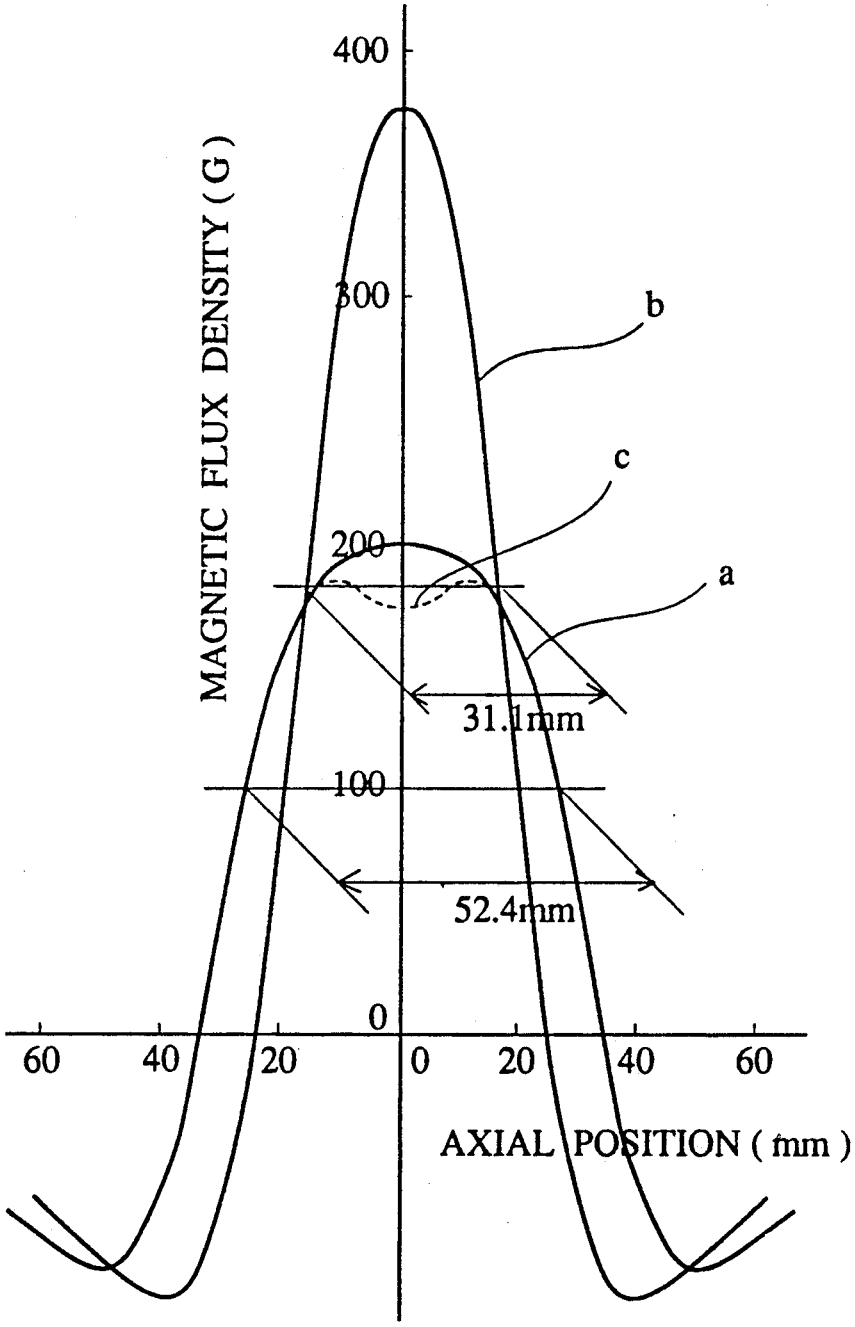
FIG. 2 is a graph showing the relation between the magnetic flux density distribution and an axial position.

FIG. 2 shows the relation between a magnetic flux density distribution along a center axis of the permanent magnet assembly and an axial position with respect to the focus magnet shown in FIG. 1. The axial position "0" is a center position of the center permanent magnet 1*a*. As is clear from FIG. 2, a magnetic flux density distribution curve "a" of the focus magnet of the present invention has a half-width of 52.4 mm, while a magnetic flux density distribution curve "b" of the conventional focus magnet of FIG. 3 has a half-width of 31.1 mm. Incidentally, these curves were obtained under the following conditions:

| | |
|---|---|
| Center permanent magnet 1a: | Sm—Co magnet ("H-18B" manufactured by Hitachi Metals, Ltd.)<br>Outer diameter = 65 mm<br>Inner diameter = 50 mm<br>Thickness = 16 mm |
| Side permanent magnet 1b: | Sm—Co magnet ("H-18B" manufactured by Hitachi Metals, Ltd.)<br>Outer diameter = 65 mm<br>Inner diameter = 50 mm<br>Thickness = 8 mm |
| Yoke 2: | Mn—Zn ferrite ("GP-7" manufactured by Hitachi Ferrite, Ltd.)<br>Outer diameter = 60 mm<br>Inner diameter = 50 mm<br>Thickness = 5 mm |
| Static control coil: | 570 turns<br>Wire Diameter = 0.2 mm<br>Inductance (1 kHz) = 22 mH<br>DC Resistance (at 20° C.) = 44.6 Ω |
| Dynamic control coil: | 26 turns<br>Wire Diameter = 0.5 mm<br>Inductance (1 kHz) = 70 μH<br>DC Resistance (at 20° C.) = 0.4 Ω |
| Dynamic control current: | Variable |

As is clear from FIG. 2, the focus magnet of the present invention can provide a much wider magnetic flux density distribution along the center axis of the permanent magnet assembly than the conventional focus magnet. Incidentally, in the conventional focus magnet shown in FIG. 3, if the permanent magnets 1, 1 are separated from each other to increase the half-width, the magnetic flux density is reduced in the vicinity of the center position "0," leading to a dented curve "c" shown by a dotted line. On the other hand, in the present invention, since three permanent magnets are arranged axially, such a dented curve is not produced.

It has been confirmed that in the focusing of electron beams in a CRT by using the focus magnet shown in FIG. 1, the electron beams can be converged to such a small spot diameter as 0.25–0.28 mm, and that a correction current supplied to the dynamic control coil 3*b* can be reduced from a conventional level (4 Ap-p: peak-to peak value) to 3 Ap-p.

As described above in detail, since the static control coil and the dynamic control coil are disposed inside different permanent magnets in the focus magnet of the present invention, only a DC current is supplied to the static control coil, making it unnecessary to use a control current consisting of a DC component and an AC component. Also, since the dynamic control coil is electromagnetically separated from the static control coil, the correction current supplied to the dynamic control coil does not induce an offsetting AC current in the static control coil. Also, in the focus magnet of the present invention, a magnetic flux density distribution along a center axis of the permanent magnet assembly has an increased half-width, leading to the increase in an integrated value of a magnetic flux density distribution curve. Therefore, the electron beams can be converged to a small spot diameter.

What is claimed is:

1. A focus magnet comprising (a) three axially magnetized hollow cylindrical permanent magnets disposed concentrically along a center axis of a cathode ray tube such that their opposite magnetic poles face each other; (b) yokes in the form of hollow discs disposed on both end surfaces of permanent magnet; (c) a static control coil disposed inside a center permanent magnet; (d) a horizontal dynamic control coil disposed inside one of side permanent magnets; and (e) a vertical dynamic control coil disposed inside the other side permanent magnet, whereby electron beams passing in said cathode ray tube are converged to a small spot diameter.

2. The focus magnet according to claim 1, wherein said three permanent magnets have substantially the same outer diameter and the same inner diameter, and an axial length of said center permanent magnet is larger than those of said side permanent magnets.

3. The focus magnet according to claim 1, wherein said permanent magnets are made of a rare earth magnet material.

4. The focus magnet according to claim 1, wherein said spot diameter of the converged electron beams is 0.25–0.28 mm.

* * * * *